US011626690B2

(12) United States Patent
Hsiao et al.

(10) Patent No.: US 11,626,690 B2
(45) Date of Patent: Apr. 11, 2023

(54) CABLE END CONNECTOR WITH HIGH RETAINING FORCE

(71) Applicant: BIZLINK INTERNATIONAL CORPORATION, New Taipei (TW)

(72) Inventors: Hsin Tuan Hsiao, New Taipei (TW); Jui Hung Chien, New Taipei (TW)

(73) Assignee: Bizlink International Corporation, New Taipei (TW)

( * ) Notice: Subject to any disclaimer, the term of this patent is extended or adjusted under 35 U.S.C. 154(b) by 0 days.

(21) Appl. No.: 17/537,844

(22) Filed: Nov. 30, 2021

(65) Prior Publication Data

US 2022/0094107 A1 Mar. 24, 2022

Related U.S. Application Data

(63) Continuation of application No. 17/021,007, filed on Sep. 15, 2020, now Pat. No. 11,228,140.

(30) Foreign Application Priority Data

Dec. 5, 2019 (TW) ..... 108216227

(51) Int. Cl.
*H01R 13/627* (2006.01)
*H01R 13/629* (2006.01)
(Continued)

(52) U.S. Cl.
CPC ..... *H01R 13/6275* (2013.01); *H01R 12/53* (2013.01); *H01R 13/10* (2013.01); *H01R 13/502* (2013.01); *H01R 13/629* (2013.01)

(58) Field of Classification Search
CPC .... H01R 13/6275; H01R 12/53; H01R 13/10; H01R 13/502; H01R 13/629; H01R 12/79; H01R 13/6335
See application file for complete search history.

(56) References Cited

U.S. PATENT DOCUMENTS 8,439,706 B2 * 5/2013 Sytsma ..... H01R 13/6582 439/607.19
8,454,381 B2 * 6/2013 Wu ..... H01R 24/60 439/352

(Continued)

FOREIGN PATENT DOCUMENTS

CN 205429310 U 8/2016
CN 207038837 U 2/2018

(Continued)

*Primary Examiner* — Abdullah A Riyami
*Assistant Examiner* — Nader J Alhawamdeh
(74) *Attorney, Agent, or Firm* — Rosenberg, Klein & Lee

(57) ABSTRACT

A cable connector configured to secure a cable is provided. The cable connector has a casing, a latch, and a pulling member. The casing is configured to secure an end of the cable. The latch has a lower portion and an upper portion. The lower portion is secured on the casing and has a lower through hole. The upper portion has at least one upper through hole and at least one protrusion. The pulling member is connected with the upper through hole and penetrates the lower through hole. While the pulling member is pulled away from the latch along a first direction, the pulling member pulls the upper portion toward the lower portion along a second direction, so as to adjust a position of the protrusion. Thus, the latch may not be separated from the casing when a user pulls the pulling member.

16 Claims, 10 Drawing Sheets

(51) Int. Cl.

| | |
|---|---|
| ***H01R 13/502*** | (2006.01) |
| ***H01R 13/10*** | (2006.01) |
| ***H01R 12/53*** | (2011.01) |

(56) References Cited

U.S. PATENT DOCUMENTS

| | | | | |
|---|---|---|---|---|
| 8,475,199 | B2 * | 7/2013 | Wang | H01R 13/6335 439/352 |
| 8,905,777 | B2 * | 12/2014 | Zhu | H01R 13/62 439/352 |
| 9,728,871 | B1 * | 8/2017 | Gutgold | H01R 12/52 |
| 10,084,271 | B2 * | 9/2018 | Xing | H01R 13/62 |
| 10,096,944 | B2 * | 10/2018 | Huang | H01R 13/64 |
| 10,236,605 | B1 * | 3/2019 | Henry | H01R 12/732 |
| 10,461,473 | B1 * | 10/2019 | Hsiao | H01R 13/6335 |
| 10,535,939 | B1 * | 1/2020 | Qiao | H01R 12/62 |
| 10,868,387 | B2 | 12/2020 | Hsiao et al. | |
| 10,879,634 | B1 * | 12/2020 | Liao | H01R 13/6587 |
| 11,075,476 | B2 * | 7/2021 | Hsiao | H01R 12/62 |
| 2010/0273335 | A1 * | 10/2010 | Wu | H01R 12/721 439/80 |
| 2020/0076123 | A1 * | 3/2020 | Yang | H01R 13/506 |
| 2020/0321727 | A1 * | 10/2020 | Li | H01R 13/6275 |
| 2020/0366016 | A1 * | 11/2020 | Hsiao | H01R 13/6583 |
| 2020/0366025 | A1 * | 11/2020 | Hsiao | H01R 13/504 |
| 2021/0075159 | A1 * | 3/2021 | Wang | H01R 13/6582 |
| 2021/0135402 | A1 * | 5/2021 | Li | H01R 13/6275 |
| 2021/0175650 | A1 * | 6/2021 | Hsiao | H01R 12/777 |
| 2021/0175663 | A1 * | 6/2021 | Hsiao | H01R 13/10 |
| 2021/0265782 | A1 * | 8/2021 | Wang | H01R 12/62 |

FOREIGN PATENT DOCUMENTS

| | | |
|---|---|---|
| TW | M314939 | 7/2007 |
| TW | M579831 U | 6/2019 |

* cited by examiner

CABLE END CONNECTOR WITH HIGH RETAINING FORCE

BACKGROUND OF THE INVENTION

1. Field of the Invention

The present invention relates to a connector mounted on a cable.

2. Description of the Prior Arts

With ever-increasing efficacy of an electronic component and capacity of a storage component, volumes of the electronic components or the storage components become larger and thus a space in a device becomes insufficient. Therefore, volumes of the cables and other components connected to the cables should be reduced for disposing the electronic components or the storage components.

One of the conventional cable connectors comprises a controllable engagement structure which can engage a component when the cable connector is connected to said component. Then, when the engagement structure is pushed, the engagement structure may be separated from said component, and thereby the connector can be detached from said component. However, currently, the cable connector does not comprise the controllable engagement structure, but comprises a detachment structure which has a resilient latch and a pulling member. The resilient latch is configured to engage another component. The pulling member is connected to the resilient latch so that when the user pulls the pulling member, the resilient latch can be separated from the connected component and drive the connector to detach from said component at the same time.

However, a transmitting capacity of the cable also needs to be increased corresponding to the efficacy of the electronic component and the capacity of a storage component, and a common means is to increase an amount of pins of the cable. Because the pins of the cable connector have to contact pins of the electronic component or the storage component, more pins generate larger resistance. On the other hand, when detaching the cable from the electronic component or the storage component, a user has to exert larger force. Nevertheless, the resilient latch of the current cable connector cannot withstand such a larger force, so the resilient latch may be detached from the cable connector before the cable connector is detached from the electronic component or the storage component.

To overcome the shortcomings, the present invention provides a cable connector and an electronic device connection system comprising the same to mitigate or obviate the aforementioned problems.

SUMMARY OF THE INVENTION

The main objective of the present invention is to provide a connector that can endure larger pulling force.

One of the preferable connectors has a casing, a latch, and a pulling member. The casing is configured to secure an end of a cable. The latch comprises a lower portion and an upper portion. The lower portion is secured on the casing and has a lower through hole. The upper portion has at least one upper through hole and at least one protrusion. The pulling member is connected with the upper through hole and penetrates the lower through hole. While the pulling member is pulled away from the latch along a first direction, the pulling member pulls the upper portion toward the lower portion along a second direction so as to adjust a position of the protrusion.

Another one of the preferable connectors has a casing, a latch, and a pulling member. The casing is configured to secure an end of a cable and has a plurality of first engaged openings formed on a top surface thereof. The latch comprises an upper portion and a lower portion connected to each other. The lower portion has a plurality of first hooks and each of the first hooks is embedded into one of the first engaged openings. The upper portion has a plurality of protrusions formed thereon. The pulling member is connected with the upper portion of the latch. While the pulling member is pulled opposite to an insertion direction, the pulling member pulls the upper portion toward the lower portion so as to adjust a position of the protrusions.

With the engagement between the protrusion of the casing and the hooked opening of the resilient latch and the engagement between the first engaged opening of the casing and the first hook of the resilient latch, the resilient latch can be durably fixed on the casing. Thus, even when the cable connector is tightly clamped by the socket, the user still can drive the resilient latch and the casing by pulling the pulling member, and thereby detach the casing from the socket. In other words, as long as the resilient latch is firmly mounted on the casing, the resilient latch may not be separated from the casing when the user pulls the pulling member, which ensures that the casing will be detached from the socket when the pulling member is pulled.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
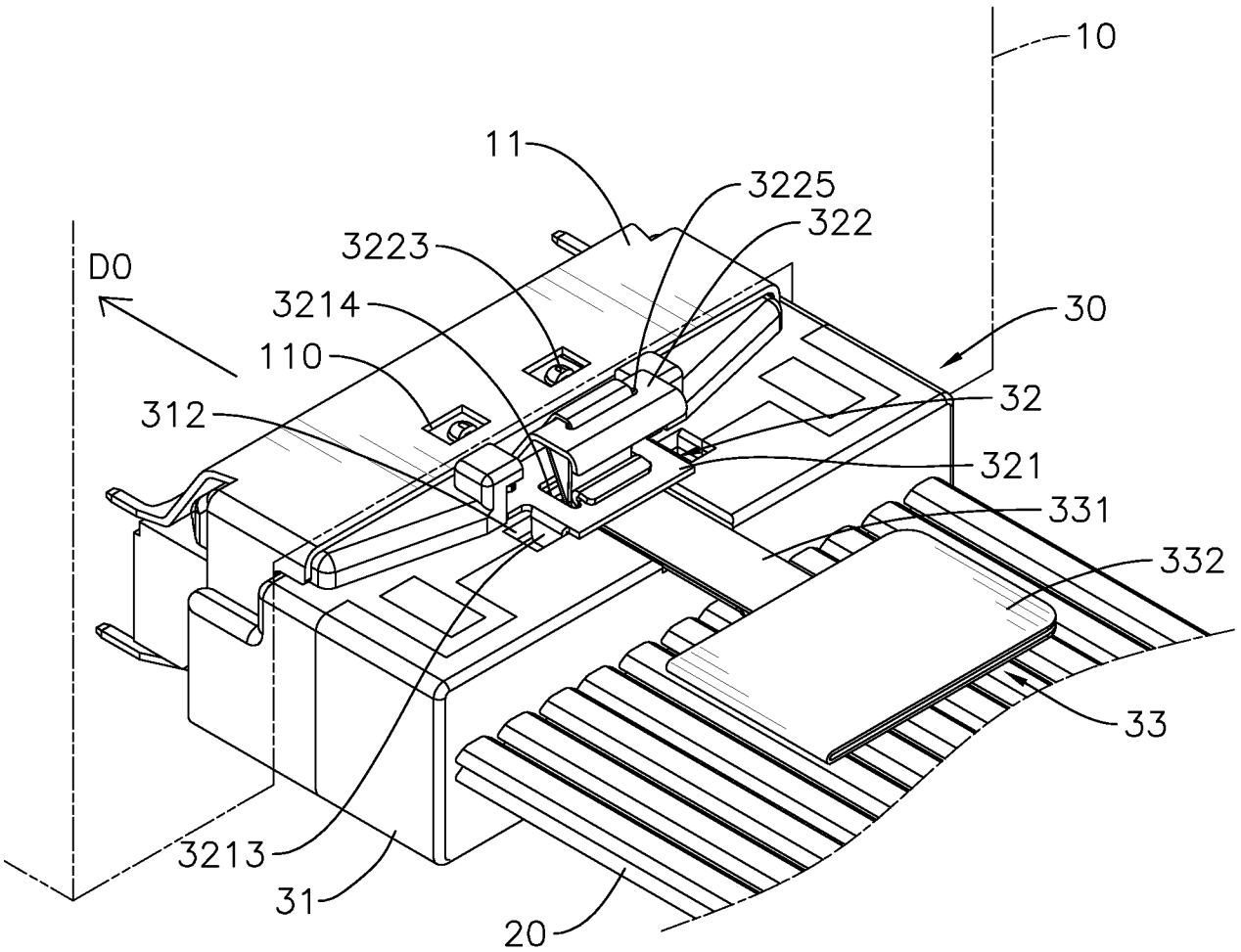
FIG. 1 is a perspective view of an electronic device connection system in accordance with the present invention.
Figure 2:
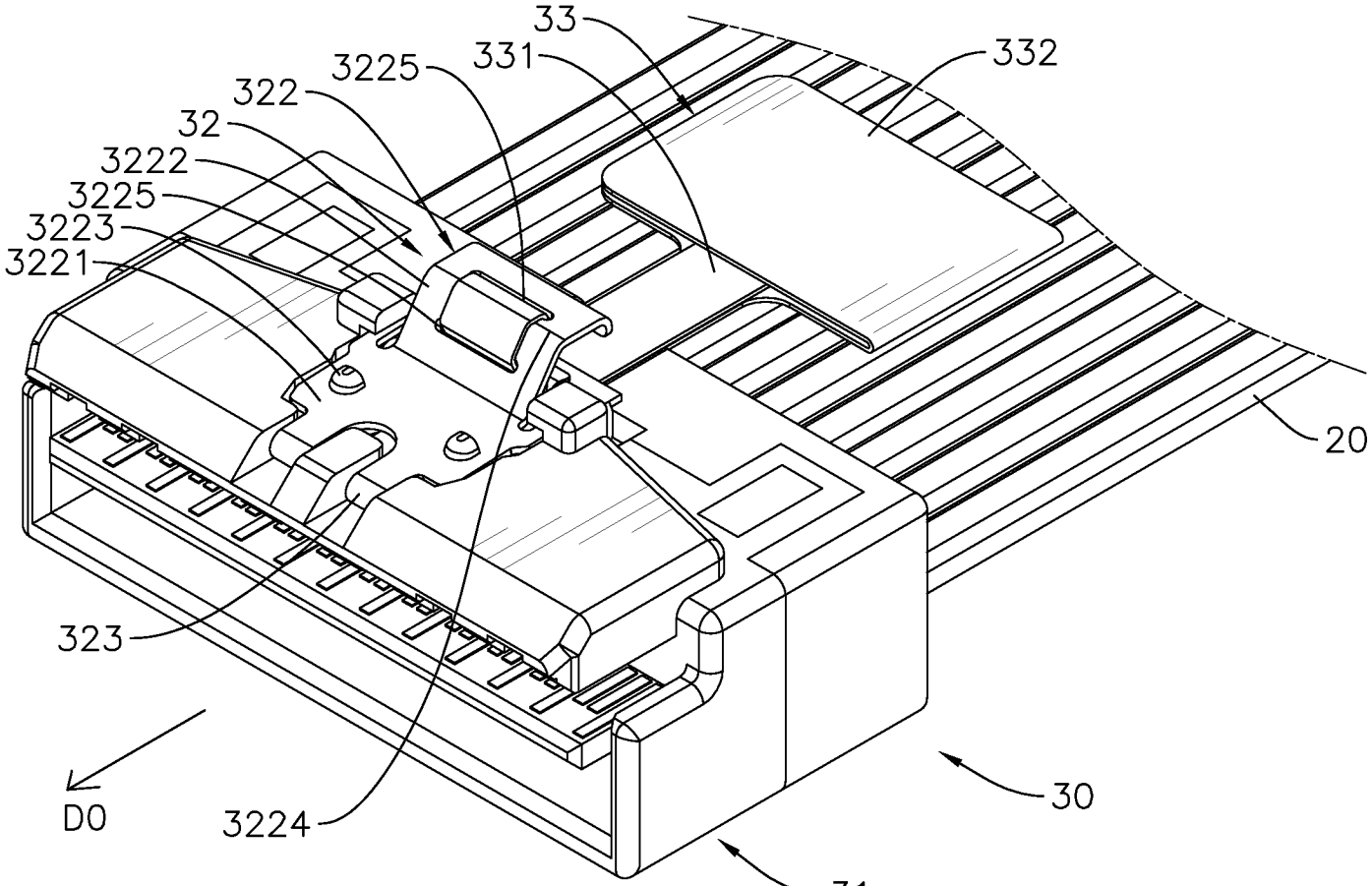
FIG. 2 is a perspective view of a cable connector and a cable of the electronic device connection system in FIG. 1.

With reference to FIG. 1, an electronic device connection system in accordance with the present invention is provided and comprises an electronic device 10, a cable 20, and a cable connector 30. The cable 20 includes a first end and a second end. The cable connector 30 is securely mounted on the first end of the cable 20 and thereby the cable 20 is mounted through the cable connector 30. The second end of the cable 20 is connected to a circuit board or another electronic device. The electronic device 10 comprises a socket 11 and the cable connector 30 is detachably mounted into the socket 11 and thereby the electronic device 10 is electrically connected to the cable 20. A movement direction in which the cable connector 30 is inserted into the socket 11 is defined as an insertion direction D0.

Then please refer to FIG. 2 to FIG. 5. The cable connector 30 comprises a casing 31, a resilient latch 32, and a pulling member 33. The casing 31 is sleeved on the first end of the cable 20 and comprises an outer wall 310, at least one protrusion 311, and at least one first engaged opening 312. Both of the at least one protrusion 311 and the at least one first engaged opening 312 are formed on the outer wall 310. In the insertion direction D0, the at least one protrusion 311 is located in front of the at least one first engaged opening 312. The resilient latch 32 is securely mounted on the casing 31 by the at least one protrusion 311 and the at least one first engaged opening 312. The resilient latch 32 comprises a first sheet 321, a second sheet 322, and a connection portion 323. The first sheet 321 is securely mounted on the casing 31. Precisely, the first sheet 321 comprises a first sheet main body 3211, at least one hooked opening 3212, at least one first hook 3213, and a through hole 3214. The at least one hooked opening 3212 is formed on the first sheet main body 3211. The at least one first hook 3213 extends from the first sheet main body 3211. The at least one protrusion 311 of the casing 31 is configured to be received and engaged in the at least one hooked opening 3212; the at least one first hook 3213 is configured to be received and engaged in the at least one first engaged opening 312.

Figure 6:
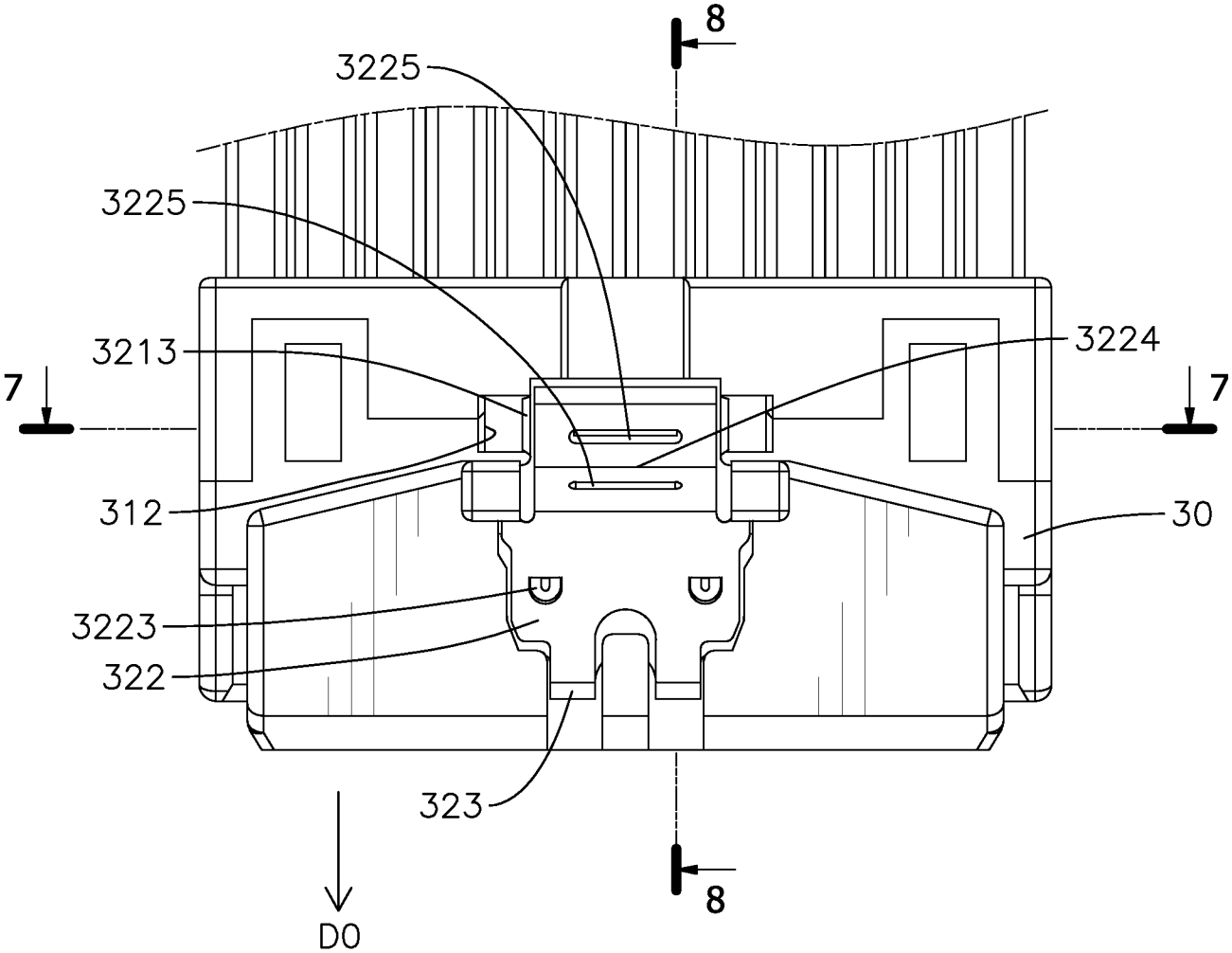
FIG. 6 is a top view of the cable connector in FIG. 1.
Figure 7:
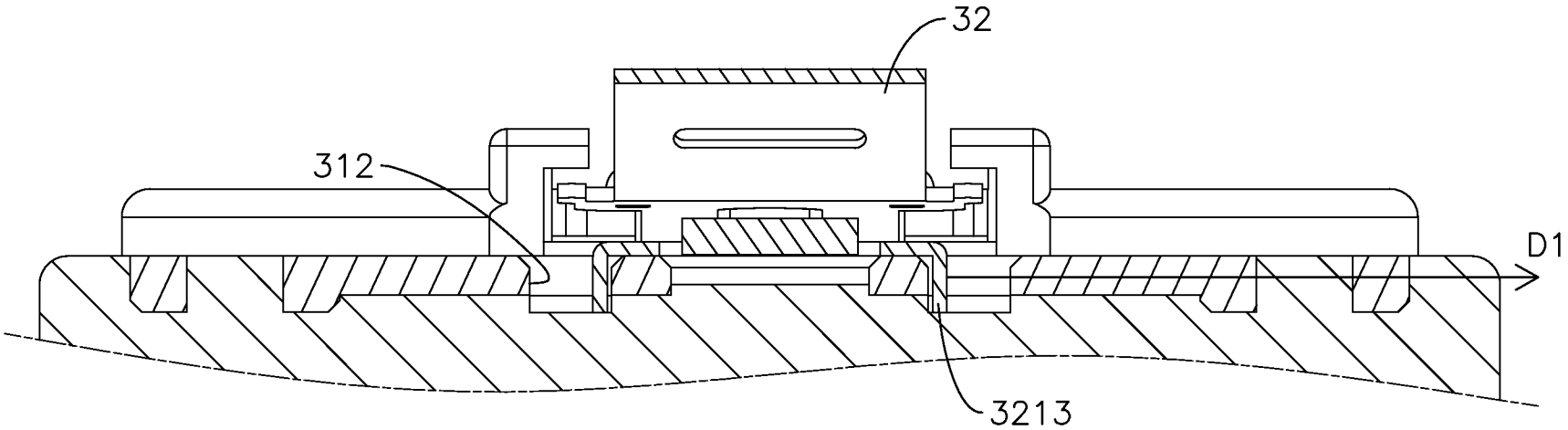
FIG. 7 is a sectional view of the cable connector across line 7-7 in FIG. 6.

Then please refer to FIG. 6 and FIG. 7 together. In this embodiment, the resilient latch 32 is securely mounted on the outer wall 310 of the casing 31, and the first sheet main body 3211 and the at least one first hook 3213 are mounted on the same surface. The first sheet main body 3211 and the at least one first hook 3213 may be a sheet formed integrally. During mounting of the resilient latch 32 on the casing 31, the at least one hooked opening 3212 of the first resilient latch 32 is disposed around the at least one protrusion 311 of the casing 31 first, and then the at least one first hook 3213 of the first resilient latch 32 is aligned with the at least one first engaged opening 312 of the casing 31, and then the at least one first hook 3213 is bent into the at least one first engaged opening 312. Thus, the at least one first hook 3213 engages the at least one first engaged opening 312.

Precisely, the at least one first hook 3213 is bent at a line, parallel with the insertion direction D0, on the first sheet main body 3211 so that the at least one first hook 3213 is moved into the at least one first engaged opening 312. In this embodiment, each first hook 3213 is a plate and a normal direction of the plate is defined as a first direction D1. The first direction D1 is perpendicular to the insertion direction D0 of the cable connector 30. In other words, the plate extends in the insertion direction D0 so the at least one first hook 3213 can sustain more force in the insertion direction D0.

Figure 8:
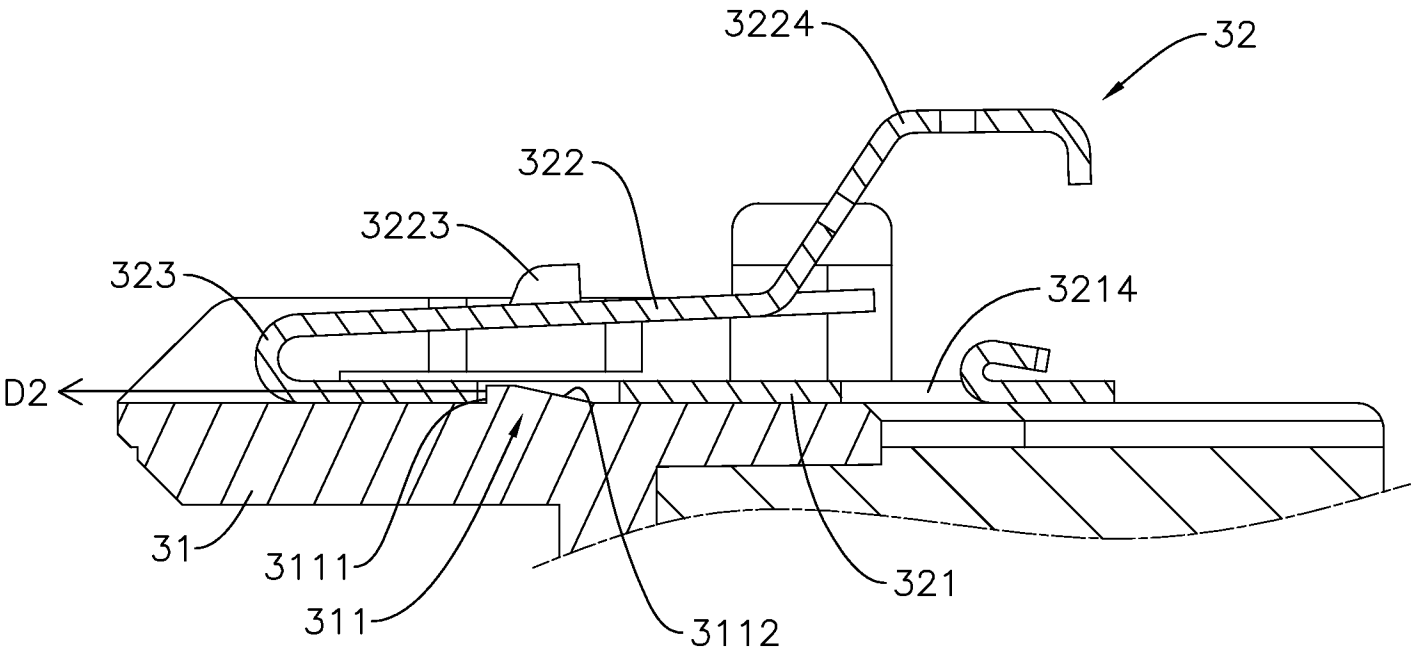
FIG. 8 is a sectional view of the cable connector across line 8-8 in FIG. 6.

Then please also refer to FIG. 6 and FIG. 8. Similarly, each one of the at least one protrusion 311 of the casing 31 forms multiple surfaces, and one of said surfaces is an engaging surface 3111 and another one is a guiding surface 3112. The engaging surface 3111 is away from the pulling member 33 and the guiding surface 3112 is close to the pulling member 33. A normal direction of the engaging surface 3111 is defined as a second direction D2. The second direction D2 is parallel with the insertion direction D0 of the cable connector 30. After the resilient latch 32 is fixed on the casing 31, the at least one protrusion 311 of the casing 31 is received in the at least one hooked opening 3212 of the resilient latch 32 and the engaging surface 3111 abuts an inner edge of each hooked opening 3212, and thereby the resilient latch 32 may not detach from the protrusion 311 when subjected to a force opposite the insertion direction D0. The guiding surface 3112 is inclined with respect to the insertion direction D0 of the cable connector 30, which facilitates the resilient latch 32 to be mounted on the casing 31.

Figure 3:
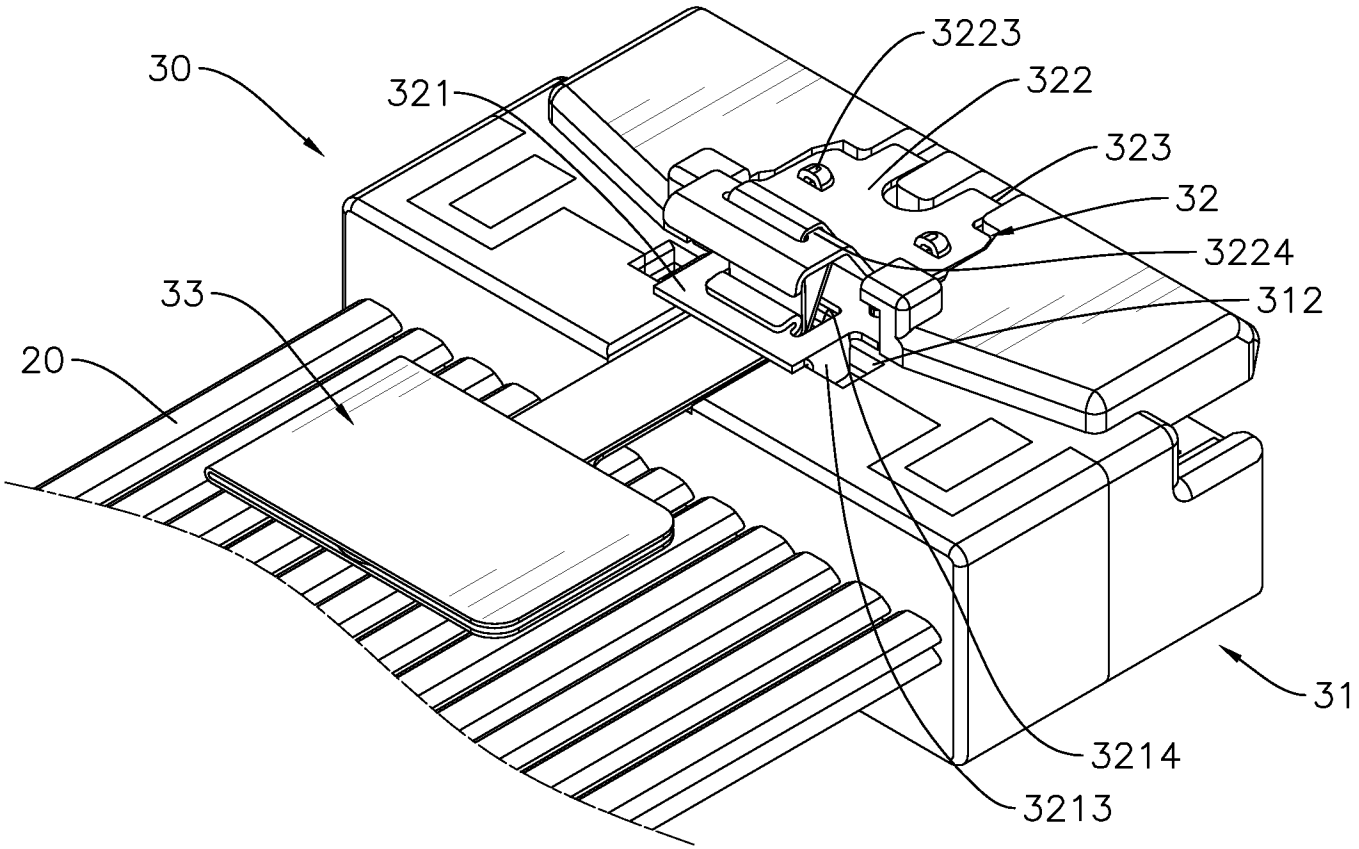
FIG. 3 is another perspective view of the cable connector and the cable in FIG. 1.
Figure 4:
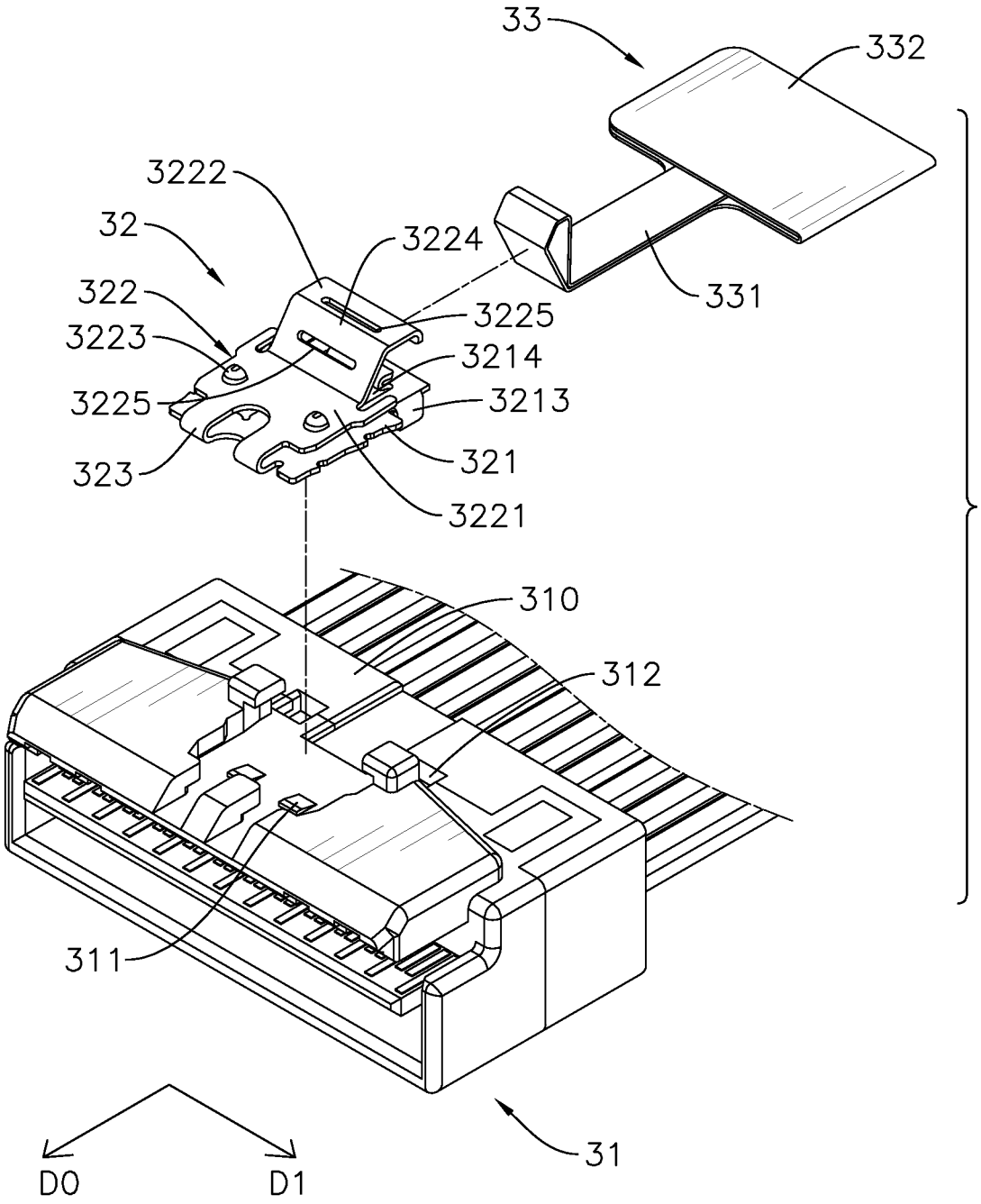
FIG. 4 is an exploded view of the cable connector in FIG. 1.
Figure 5:
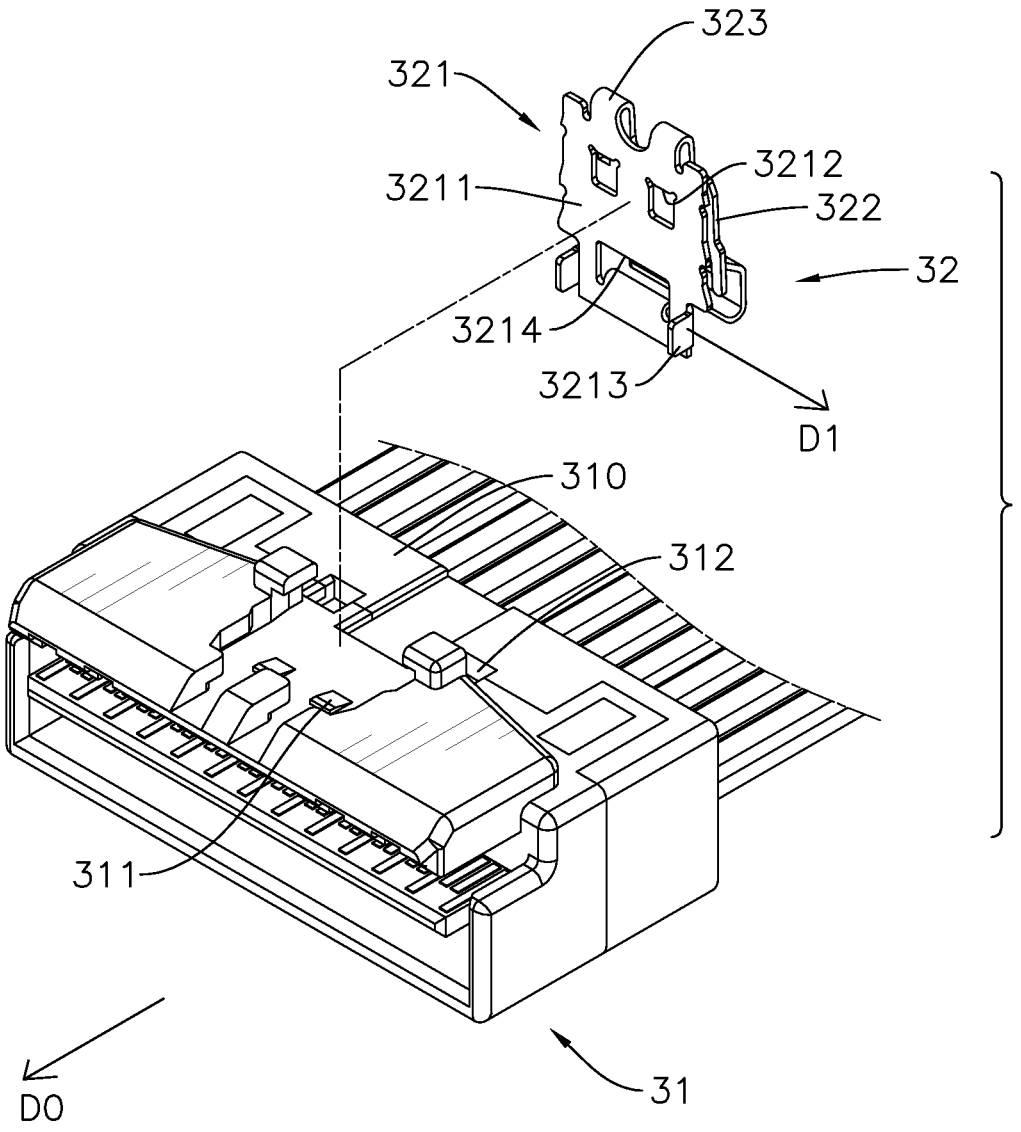
FIG. 5 is another exploded view of the cable connector in FIG. 1.

Then please refer to FIG. 3 and FIG. 4. The second sheet 322 and the first sheet 321 are spaced apart from each other and connected to each other via the first sheet 321. In other words, the connection portion 323 connects the first sheet 321 and the second sheet 322. The connection portion 323 is elastic and bendable, so when the resilient latch 32 is subjected to an external force, an angle between the second sheet 322 and the first sheet 321 may be changed. The second sheet 322 comprises a main body piece 3221, an operation piece 3222, and at least one second hook 3223. The main body piece 3221 is connected to the connection portion 323 and spaced apart from the first sheet 321. The operation piece 3222 comprises two ends opposite each other. One of the ends of the operation piece 3222 is securely mounted on the main body piece 3221. The other end of the operation piece 3222 obliquely extends away from the first sheet 321. The at least one second hook 3223 is securely mounted on the main body piece 3221 and extends away from the first sheet 321.

Figure 9:
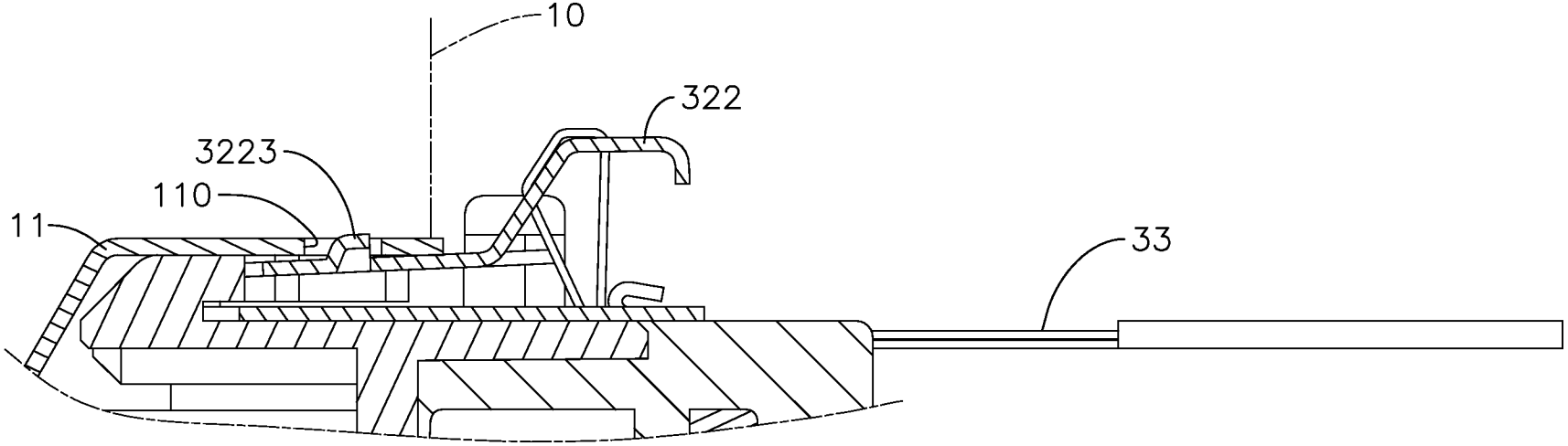
FIG. 9 and FIG. 10 are serial operational views of the electronic device connection system showing the cable connector detached from an electronic device of the electronic device connection system.
Figure 10:
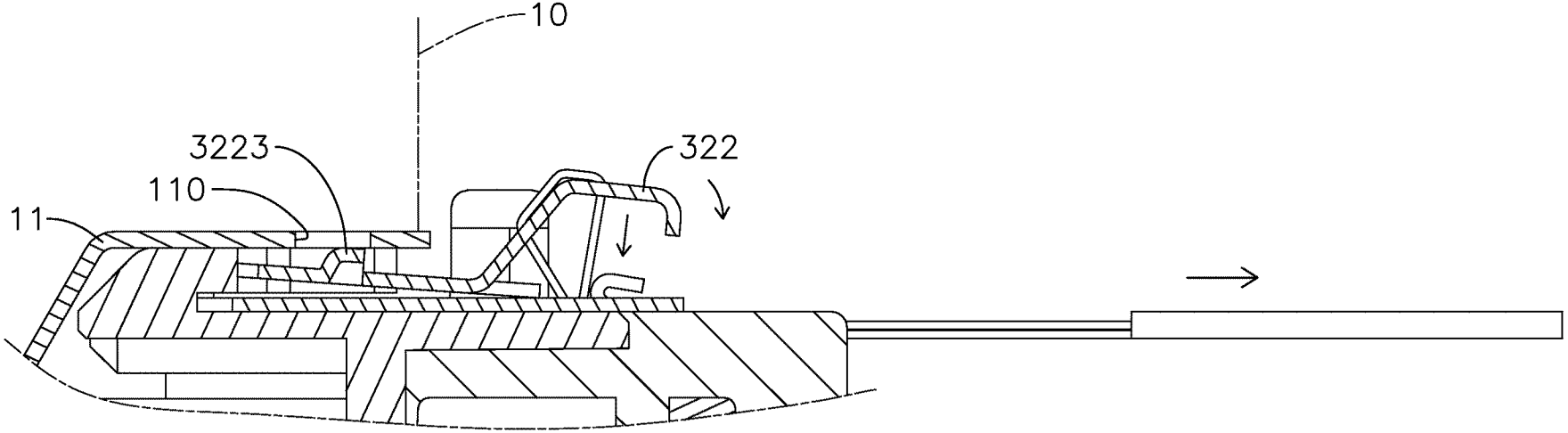

Then please also refer to FIG. 9 and FIG. 10. The operation piece 3222 may be a detachment structure of the second sheet 322 and the pulling member 33 is connected to the detachment structure. In this embodiment, the pulling member 33 comprises a connecting belt 331 and a handle 332. The operation piece 3222 comprises a beam portion 3224. The connecting belt 331 comprises a first end and a second end opposite each other. The first end of the connecting belt 331 is connected to the operation piece 3222 of the second sheet 322 and the handle 332 is securely mounted on the second end of the connecting belt 331.

In this embodiment, the operation piece 3222 forms two traverse holes 3225 and the beam portion 3224 is located between the two traverse holes 3225. The connecting belt 331 of the pulling member 33 is sequentially mounted through the two traverse holes 3225 and thereby is winded on the beam portion 3224. In other words, the connecting belt 331 is connected to the operation piece 3222 so when a user pulls the pulling member 33, a moment may be exerted on the resilient latch 32 to tilt the second sheet 322.

In a preferred embodiment, the connecting belt 331 of the pulling member 33 passes through the through hole 3214 of the first sheet 321 from a surface, away from the second sheet 322, of the first sheet 321 and then is winded on the beam portion 3224 of the operation piece 3222, so that the first end of the connecting belt 331 is connected to the second sheet 322. Therefore, the connecting belt 331 extends from the first sheet 321 to the second sheet 322, and thereby when the user pulls the pulling member 33, the pulling member 33 may drive the second sheet 322 to move toward the first sheet 321, which facilitates the second sheet 322 to be tilted.

The socket 11 comprises at least one second engaged opening 110. When the cable connector 30 is mounted on the socket 11, the second hook 3223 of the cable connector 30 is received and engaged in the second engaged opening 110 of the socket 11. To separate the cable connector 30 from the socket 11, the user may just pull the pulling member 33 to tilt the second sheet 322 toward the first sheet 321, and thereby the at least one second hook 3223 of the second sheet 322 is detached from the at least one second engaged opening 110 of the socket 11. At the same time, the at least one hooked opening 3212 and the at least one first hook 3213 of the first sheet 321 are still respectively fixed on the at least one protrusion 311 and the at least one first engaged opening 312 of the casing 31, and thereby the resilient latch 32 can drive the casing 31 to detach from the socket 11. Besides, except for the engagement between the at least one hooked opening 3212 and the at least one protrusion 311, the present invention further includes the engagement between the at least one first hook 3213 and the at least one first engaged opening 312, so the resilient latch 32 may sustain larger pulling force.

Consequently, with the engagement between the at least one protrusion 311 and the at least one hooked opening 3212 and the engagement between the at least one first engaged opening 312 and the at least one first hook 3213, the resilient latch 32 can be durably fixed on the casing 31. Thus, even when the cable connector 30 is tightly clamped by the socket 11, the user still can drive the resilient latch 32 and the casing 31 by pulling the pulling member 33, and thereby detach the casing 31 from the socket 11. In other words, as long as the resilient latch 32 is firmly mounted on the casing 31, the latch 32 may not be separated from the casing 31 while the user is pulling the pulling member 33, which ensures that the casing 31 will be detached from the socket 11 when the pulling member 33 is pulled.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cable end connector with high retaining force, the cable end connector comprising:

a casing configured to secure an end of a cable therein;

a latch comprising a lower portion and an upper portion, the lower portion being secured on the casing, the lower portion having a lower through hole, the upper portion having two upper through holes and at least one protrusion;

a pulling member connected with the upper through holes and penetrating the lower through hole; the pulling member being a flexible pulling strip and comprising:

an annular structure at an end of the flexible pulling strip, the annular structure connected to and tied up on the two upper through holes at the same time;

wherein, while the pulling member is pulled away from the latch along a first direction, the pulling member pulls the upper portion toward the lower portion along a second direction so as to adjust a position of the protrusion.

2. The cable end connector with high retaining force as claimed in claim 1, wherein:

at least one first engaged opening is formed on a top wall of the casing; and the lower portion of the latch has at least one first hook, each of the at least one first hook is configured to be engaged in the at least one first engaged opening.

3. The cable end connector with high retaining force as claimed in claim 2, wherein:

a passage is formed between the latch and the case, extends along the first direction, and is configured to receive the pulling member; and the first direction is substantially perpendicular to the second direction.

4. The cable end connector with high retaining force as claimed in claim 2, wherein:

the at least one first hook includes multiple said first hooks; and the at least one first engaged opening includes multiple said first engaged openings.

5. The cable end connector with high retaining force as claimed in claim 3, wherein the passage is located on an upper surface of the casing and concaved inward at said upper surface.

6. A cable end connector with high retaining force, the cable end connector comprising:

a casing configured to secure an end of a cable therein; multiple first engaged openings formed on a top wall of the casing;

a latch comprising a lower portion and an upper portion, the lower portion being secured on the casing, the lower portion having a lower through hole and multiple first hooks, each of the first hooks configured to be engaged in the first engaged openings, the upper portion having:

two upper through holes;

a top surface; one of said upper through holes is formed on the top surface;

an incline surface, a slope of the incline surface is different for that of the tope surface; the other one of said upper through holes is formed on the incline surface;

a beam portion defined between said two upper through holes thereby separating said two upper through holes; and at least one protrusion;

a pulling member connected with the upper through holes and penetrating the lower through hole;

wherein, while the pulling member is pulled away from the latch along a first direction, the pulling member pulls the upper portion toward the lower portion along a second direction so as to adjust a position of the protrusion.

7. A cable end connector with high retaining force, the cable end connector comprising:

a casing configured to secure an end of a cable therein;

a latch comprising a lower portion and an upper portion, the lower portion being secured on the casing, the lower portion having a lower through hole, the upper portion having at least one upper through hole and at least one protrusion;

a pulling member connected with the upper through hole and penetrating the lower through hole; the pulling member being a flexible pulling strip and comprising:

an annular structure at an end of the flexible pulling strip, the annular structure connected to and tied up on the upper through hole;

a handle; and a turning portion located between the handle and the annular structure; the turning portion abuts a rear wall of the lower through hole of the latch and thereby the turning portion is bent;

wherein, while the pulling member is pulled away from the latch along a first direction, the pulling member pulls the upper portion toward the lower portion along a second direction so as to adjust a position of the protrusion.

8. The cable end connector with high retaining force as claimed in claim 7, wherein the lower through hole of the latch is a closed hole.

9. The cable end connector with high retaining force as claimed in claim 8, wherein the lower through hole of the latch comprises:

a guiding structure mounted on the rear wall of the lower through hole and extending form said rear wall and then extending rearward.

10. The cable end connector with high retaining force as claimed in claim 9, wherein:

a through hole is formed on the lower portion of the latch;

a projection protruding upward out of the casing and engaged with the through hole of the latch.

11. A cable end connector with high retaining force, the cable end connector comprising:

a casing configured to secure an end of a cable therein, the casing having a plurality of first engaged openings formed on a top surface thereof;

a latch comprising an upper portion and a lower portion connected to each other, the lower portion having a plurality of first hooks, each of the plurality of the first hooks being embedded into one of the first engaged openings, the upper portion having a plurality of protrusions formed thereon and two upper through holes;

a pulling member connected with the upper portion of the latch, while the pulling member being pulled opposite to an insertion direction, the pulling member pulling the upper portion toward the lower portion so as to adjust a position of the protrusions; the pulling member being a flexible pulling strip and comprising:

an annular structure at an end of the flexible pulling strip, the annular structure connected to and tied up on the two upper through holes at the same time.

12. The cable end connector with high retaining force as claimed in claim 11, wherein:

a passage is formed between the latch and the case, extends along the first direction, and is configured to receive the pulling member; and the first direction is substantially perpendicular to the second direction.

13. The cable end connector with high retaining force as claimed in claim 12, wherein the passage is located on an upper surface of the casing and concaved inward at said upper surface.

14. The cable end connector with high retaining force as claimed in claim 11, wherein the upper portion comprises:

a top surface; one of the upper through holes is formed on the top surface;

an incline surface, a slope of the incline surface is different for that of the tope surface; the other one of the upper through holes is formed on the incline surface;

a beam portion defined between said two upper through holes thereby separating the two upper through holes.

15. The cable end connector with high retaining force as claimed in claim 11, wherein the pulling member further comprises:

a handle; and a turning portion located between the handle and the annular structure; the turning portion abuts a rear wall of a lower through hole of the latch and thereby the turning portion is bent.

16. The cable end connector with high retaining force as claimed in claim 15, wherein the lower through hole of the latch comprises:

a guiding structure mounted on the rear wall of the lower through hole and extending form said rear wall and then extending rearward.

* * * * *